United States Patent [19]

Fukushima et al.

[11] 4,357,070

[45] Nov. 2, 1982

[54] INTERLOCKING ELECTRIC CONNECTORS

[75] Inventors: Kazunobu Fukushima, Toyota; Masatomo Motokawa, Yokkaichi, both of Japan

[73] Assignees: Tokai Electric Wire Company Limited, Yokkaichi; Toyota Jidosha Kogyo Kabushiki Kaisha, Toyota, both of Japan

[21] Appl. No.: 173,285

[22] Filed: Jul. 29, 1980

[30] Foreign Application Priority Data

Jul. 30, 1979 [JP] Japan ..... 54-105009[U]

[51] Int. Cl.[3] ..... H01R 13/28

[52] U.S. Cl. ..... 339/278 T; 339/47 C

[58] Field of Search ..... 339/47 R, 47 C, 276 T, 339/278 T

[56] References Cited

U.S. PATENT DOCUMENTS

| | | | |
|---|---|---|---|
| Re. 23,869 | 9/1954 | Macy | 339/47 R |
| 195,988 | 10/1877 | Culter | 339/47 C |
| 1,678,166 | 7/1928 | Repay | 339/47 R |
| 1,736,373 | 11/1929 | Seeger | 339/47 C |
| 3,316,522 | 4/1967 | Demler, Sr. | 339/47 C |
| 4,273,401 | 6/1981 | Katzin | 339/47 R |

FOREIGN PATENT DOCUMENTS 48-7244 1/1973 Japan .

*Primary Examiner*—John McQuade

*Attorney, Agent, or Firm*—Cushman, Darby & Cushman

[57] ABSTRACT

An electric connector comprising a pair of interlocking crimp-type terminals having bolt holes in flat contact portions which are brought into concentric relationship when the terminals are locked by means of interlocking lugs each extended from the outer circumference of each terminal. The bolt hole of one or a large terminal has a pair of diametrically opposite notches so that the flat contact portion of the other or a small terminal is partially inserted into the hole of one terminal in such a way that the flat contact portions of the terminals overlap each other with the concentric bolt holes and the interlocking lugs engage with each other, preventing the displacement of the terminals.

4 Claims, 19 Drawing Figures

INTERLOCKING ELECTRIC CONNECTORS

BACKGROUND OF THE INVENTION

The present invention relates to a flat electric connector which can simplify the assembly of wire harnesses for electrical equipments and the installation of wire harness in the latter, and a wire harness having the flat electric connector.

In general, in order to interconnect the components in an electrical equipment, a wire harness is assembled by connecting electric connectors to a network of wires laid in accordance with the layout of the components and then winding with tapes so as to bind the connectors and wires together.

Thus assembled wire harnesses are installed in the electric equipments moving on the assembly conveyor. It follows therefore that the step for attaching the connectors such as crimp type ring terminals over the terminal bolts of the electric components and tightening the nuts must be accomplished quickly and positively.

When two prior art ring terminals as shown in FIG. 8 are mounted on a single bolt and a nut is tightened to clamp them securely, it occurs very frequently that because a clamping portion 7 is thickner than a ring portion 8, the upper terminal rides over the crimping portion 7 of the lower terminal so that the upper and lower ring portions are separated from each other.

The present invention overcomes the above and other problems encountered when the prior art terminals are used in assemblying wire harnesses and provides electric connectors which can attain the snug contacts between the contact plates or rings of the upper and lower terminals.

With the crimp type flat ring terminals in accordance with the present invention, a plurality of wire harness elements can be taped together.

In FIG. 9 is shown the prior art process for assemblying wire harnesses. Wire harness elements A and B as shown in FIG. 9(*a*) are added with branches A' and B' as shown in FIG. 9(*b*). These branches A' and B' are connected to a common flat terminal 9 as shown in FIG. 9(*c*) and the wires are bundled together with tape 10 as shown in FIG. 9(*d*).

A crimp type ring terminal as shown in FIG. 8(*b*) or FIG. 8(*c*) is used as the common terminal 9. A crimping tool or the like is used to connect the branches A' and B' to the common terminal 9 or 9'. Therefore the wire harness elements A and B, which are long, must be brought close to the crimping tool or the like so that the crimping operation becomes difficult.

With the interlocking terminals 1 and 3 in accordance with the present invention, the assembly of a wire harness is much simplified as shown in FIG. 10. A small terminal 1 and a large terminal 3 are connected to branches A' and B', respectively, by using a crimping tool or the like. In like manner, components are connected so that wire harness elements A and B as shown in FIG. 8(*b*) are assembled. Next as shown in FIG. 8(*c*), the elements A and B are connected by interlocking the small and large terminals 1 and 3 as will be described in detail below. Unlike the assembly process shown in FIG. 9, no crimping tool or the like is needed. The small and large terminals 1 and 3 can be interengaged securely before or after the wires are taped as shown in FIG. 9(*d*).

As described above, with the interlocking terminals in accordance with the present invention, the assembly of wire harnesses can be much simplified.

DESCRIPTION OF THE PREFERRED EMBODIMENTS

First Embodiment, FIGS. 1 through 4

Figure 1A:
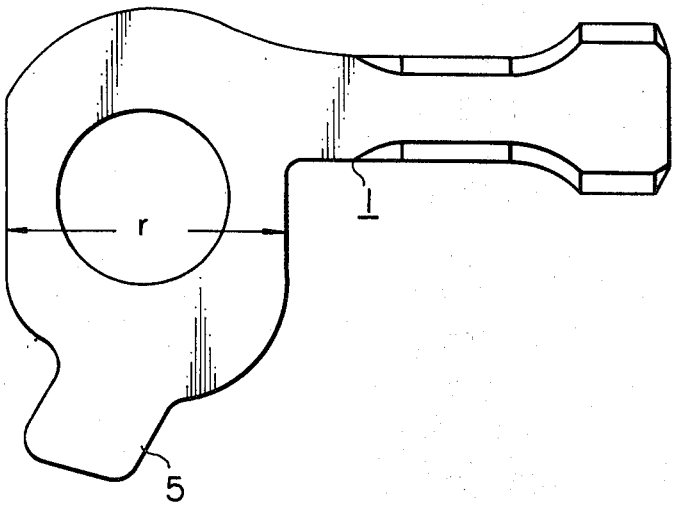
FIGS. 1(*a*) and 1(*b*) are top views, respectively, of a small terminal and a large terminal of a first embodiment of the present invention.
Figure 1B:
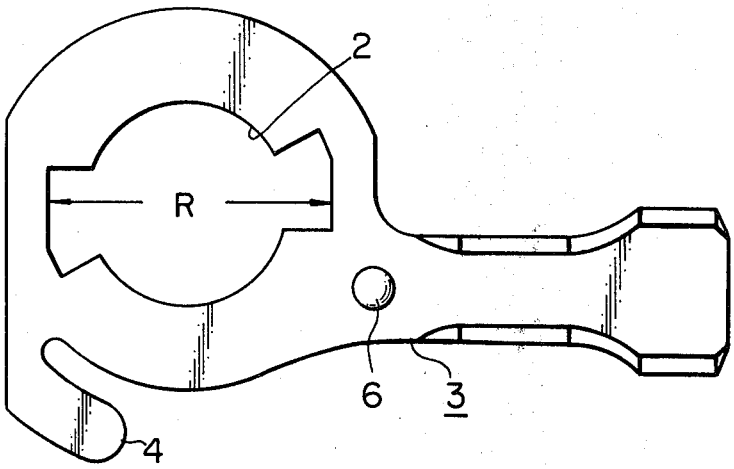

Referring to FIG. 1, a maximum diameter R of the bolt hole 2 of a large terminal 3 is greater than a maximum diameter or height r of a small terminal 1. Therefore, the small terminal 1 can passes through the hole 2 of the large terminal 3 and the small and large terminals 1 and 3 can be securely locked by means of interengaging lugs 5 and 4.

Figure 2:
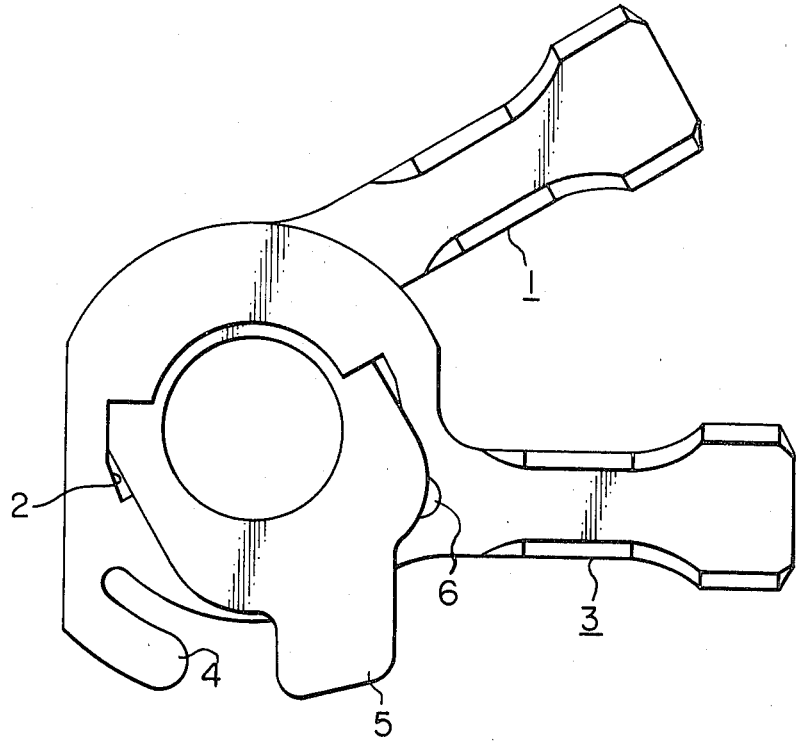
FIG. 2 shows the step of interlocking the small and large terminals.
Figure 3:
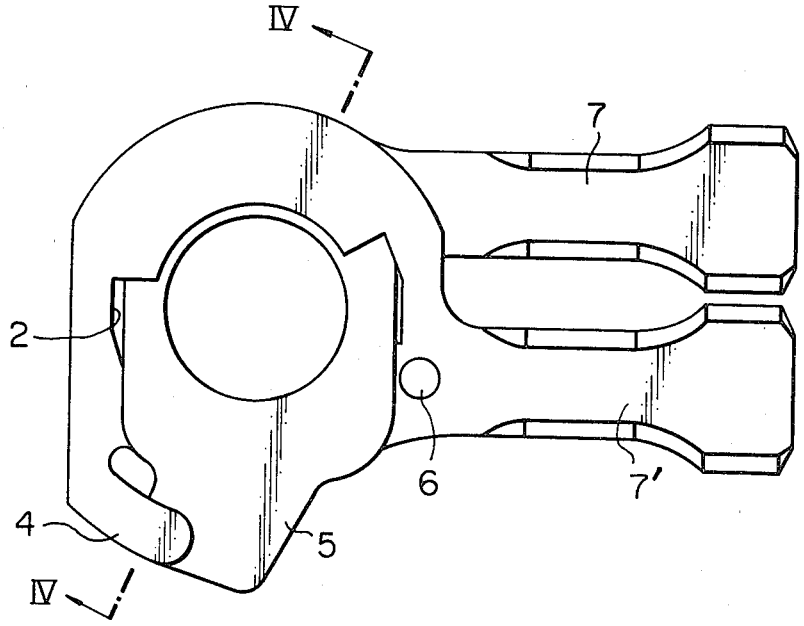
FIG. 3 is a top view showing the small and large terminals interlocked.

As shown in FIG. 2, the small terminal 1 is inserted into the hole 2 of the large terminal 3 in such a way that the lug 5 is spaced apart from the mating lug 4 of the larger terminal 3. Thereafter, the small terminal 1 is rotated in the clockwise direction so that the lugs 4 and 5 are interlocked with each other as shown in FIG. 3. When the lugs 4 and 5 are interlocked, the contact rings of the small and large terminals 1 and 3 are pressed against each other because of a close, resilient contact between the lugs 4 and 5.

A stop or projection 6 extends from the large terminal 3 so that the small terminal 1 is prevented from disengaging from the large terminal 3 as shown in FIG. 2.

Figure 4:
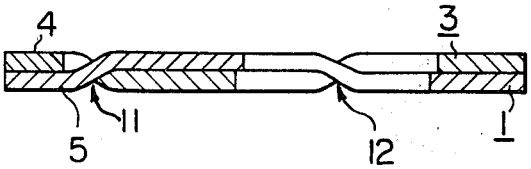
FIG. 4 is a sectional view taken along the line IV—IV of FIG. 3.

Furthermore, as shown in FIG. 4, the lugs 4 and 5 are interlocked so that a further rotation in clockwise direction of the small terminal 1 is prevented. As a result, the sleeve portion 7 of the small terminal 1 is prevented from overriding the sleeve portion 7' of the large terminal 3.

Figure 5A:
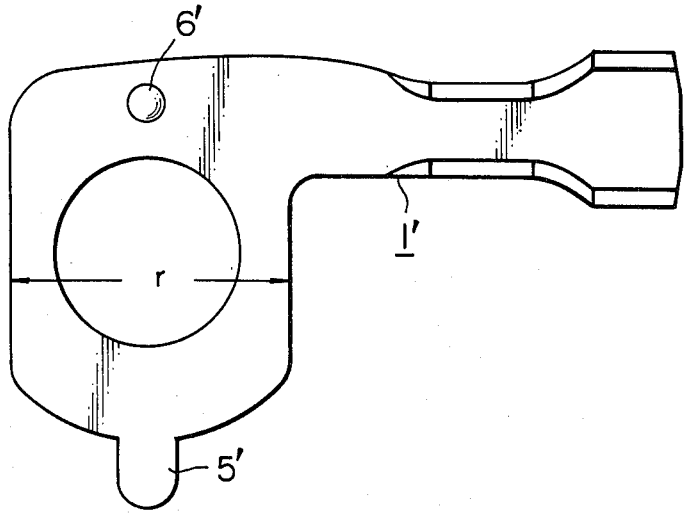
FIGS. 5(*a*) and 5(*b*) are top views, respectively, of a small terminal and a large terminal of a second embodiment of the present invention.
Figure 5B:
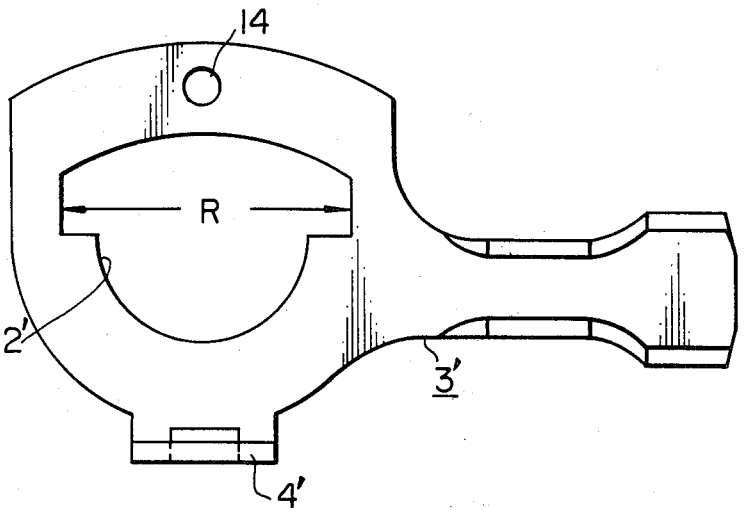
Figure 6:
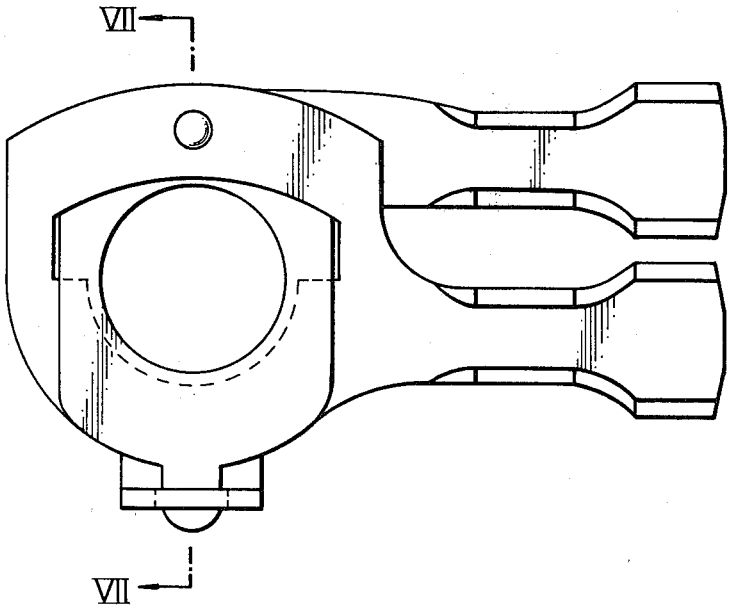
FIG. 6 shows the interlocked small and large terminals.
Figure 7:
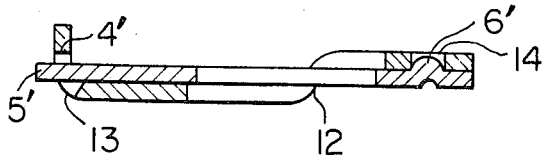
FIG. 7 is a sectional view taken along the line VII—VII of FIG. 6.
Figure 8A:
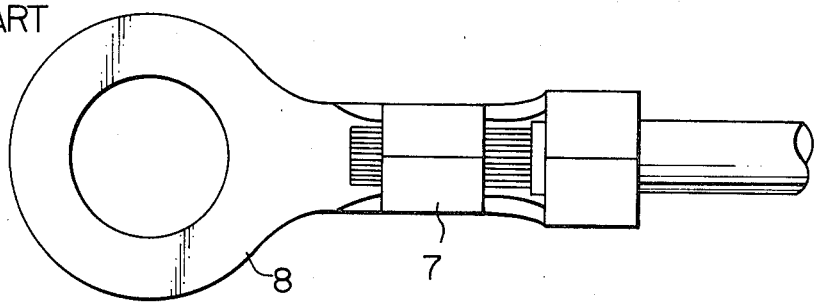
FIG. 8a PRIOR ART
FIGS. 8(*a*) to 8(*c*) show the prior art crimp type terminals for the sake of comparison with the interlocking terminals in accordance with the present invention.
Figure 8B:
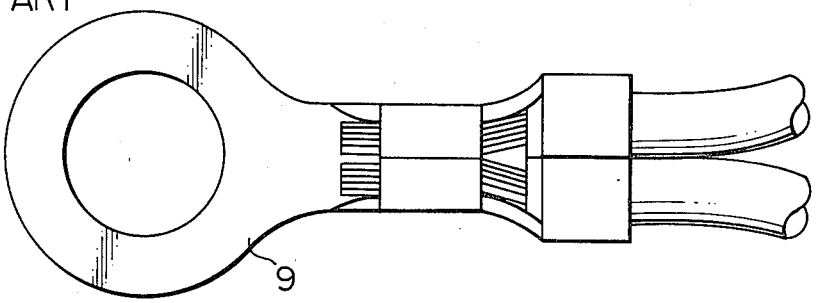
FIG. 8b PRIOR ART
Figure 8C:
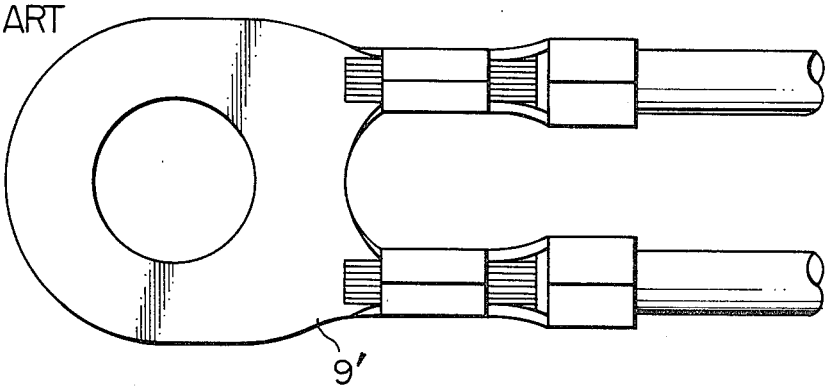
FIG. 8c PRIOR ART
Figure 9A:
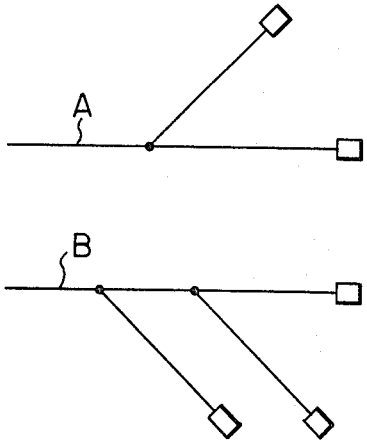
FIG. 9a PRIOR ART
FIGS. 9(*a*) to 9(*d*) show the steps of the prior art wire harness assembly.
Figure 9B:
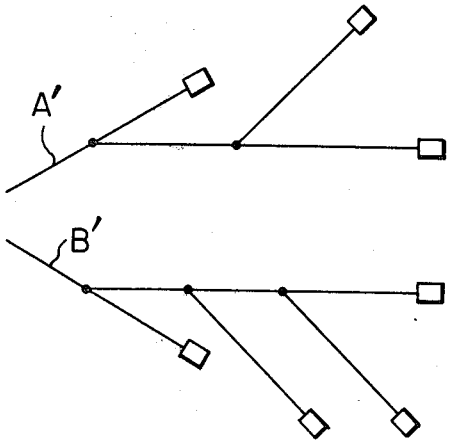
FIG. 9b PRIOR ART
Figure 9C:
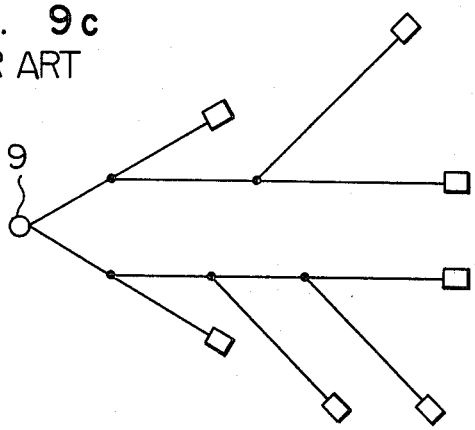
FIG. 9c PRIOR ART
Figure 9D:
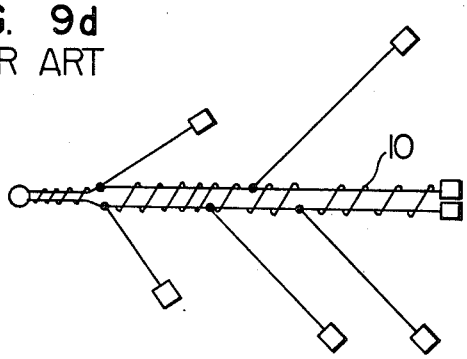
FIG. 9d PRIOR ART
Figure 10A:
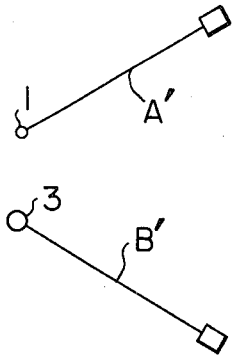
FIGS. 10(*a*) to 10(*c*) show the steps of the wire harness assembly using the interlocking terminals in accordance with the present invention.
Figure 10B:
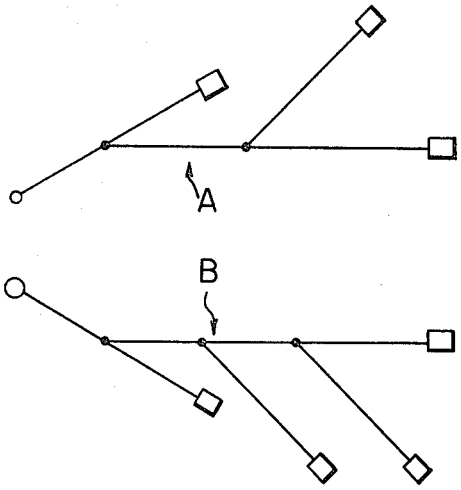
Figure 10C:
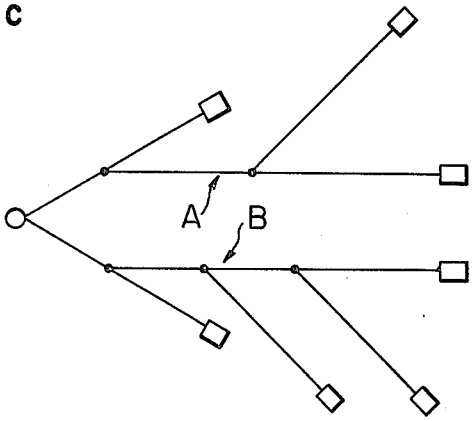

Second Embodiment, FIGS. 5 through 7

The second embodiment shown in FIGS. 5 through 7 is substantially similar in construction to the first embodiment described above with reference to FIGS. 1 through 4. A lug 5' of the small terminal 1' is passed through the bolt hole 2' of a large terminal 3' and engages with a mating lug 4' with an engaging slit. While both the small and large terminals 1 and 3 of the first embodiment have steps 11 and 12 as best shown in FIG. 4, in the second embodiment only the large terminal 3' has steps or bends 12 and 13.

In the second embodiment, as best shown in FIG. 7, when the small and large terminals 1' and 3' are interlocked, a projection 6' of the small terminal 1' engages with a mating hole 14 of the large terminal 3', so that the small and large terminals 1' and 3' are prevented from being unlocked.

In summary, the interlocking crimp type terminals in accordance with the present invention are relatively more complex in shape than the prior art terminals, but they can be manufactured in a simple manner by the prior art processes. With the interlocking crimp type terminals in accordance with the present invention, the assembly of wire harnesses can be much simplified and the assembly cost can be reduced dramatically.

What is claimed is:

1. An electric connector comprising a pair of substantially flat ring terminals each adapted to be secured to the end of an electric conductor wire, one of said terminals having an unobstructed bolt hole therethrough and the other of said terminals having an unobstructed hole therethrough through which a portion of said one terminal may be passed, each of said terminals including on its outer periphery an interlocking lug, the lug on said one terminal being on said portion thereof, the arrangement being such that said one terminal portion can be passed through the opening in said other terminal and said interlocking lugs engaged to maintain said one terminal in flatwise overlapping and underlapping engagement with said other terminal and with said bolt hole unobstructed for reception of a bolt therethrough.

2. The structure defined in claim 1 including a detent projection extending from a flat surface of one of said terminals for engagement with edge means on the other of said terminals when said terminals are assembled with the lugs in interlocking engagement to restrain disassembly thereof.

3. An electric connector as defined in claim 1 in which each terminal includes a portion adapted to be crimped onto the end of an electric conductor wire.

4. The structure defined in claim 1 including a wire harness comprising first and second harness elements having ends to which said terminals are respectively connected.

* * * * *